United States Patent [19]

Lembcke

[11] Patent Number: 4,796,708

[45] Date of Patent: Jan. 10, 1989

[54] ELECTRICALLY ACTUATED SAFETY VALVE FOR A SUBTERRANEAN WELL

[75] Inventor: Jeffrey J. Lembcke, Broken Arrow, Okla.

[73] Assignee: Baker Hughes Incorporated, Houston, Tex.

[21] Appl. No.: 164,866

[22] Filed: Mar. 7, 1988

[51] Int. Cl.[4] ..... E21B 34/06; E21B 34/16; G01V 1/40

[52] U.S. Cl. ..... 166/386; 166/66.4; 166/332; 251/129.15; 340/854

[58] Field of Search ..... 166/66.4, 65.1, 72, 166/381, 386, 332; 251/129.15, 129.22; 340/853–855; 367/81

[56] References Cited

U.S. PATENT DOCUMENTS

| | | | |
|---|---|---|---|
| 3,737,845 | 6/1973 | Maroney et al. | 166/66.4 X |
| 3,790,930 | 2/1974 | Lamel et al. | 166/113 X |
| 3,961,308 | 6/1976 | Parker | 166/72 |
| 3,967,201 | 6/1976 | Rorden | 340/854 |
| 4,191,248 | 3/1980 | Huebsch et al. | 166/66.4 |
| 4,373,582 | 2/1983 | Bednar et al. | 166/72 X |
| 4,566,534 | 4/1986 | Going, III | 166/66.4 |
| 4,579,177 | 4/1986 | Going, III | 166/66.4 |
| 4,687,054 | 8/1987 | Russell et al. | 166/66.4 |
| 4,736,791 | 4/1988 | Rorden et al. | 166/66.4 |

*Primary Examiner*—Stephen J. Novosad

*Attorney, Agent, or Firm*—Hubbard, Thurman, Turner & Tucker

[57] ABSTRACT

A downhole safety valve for a subterranean well comprises an axially shiftable valve head which is movable between open and closed positions by an actuating member. The actuating member is axially shifted by a device mechanism which is manipulated by an electric motor. The electric motor is preferably actuated by downhole batteries and the energization and de-energization of the electric motor is preferably controlled from the well surface by electromagnetic waves. A locking mechanism engages the actuating member of the safety valve in its open position through the energization of an electric solenoid, also preferably controlled from the well surface by electromagnetic waves.

28 Claims, 15 Drawing Sheets

ELECTRICALLY ACTUATED SAFETY VALVE FOR A SUBTERRANEAN WELL

BACKGROUND OF THE INVENTION

1. Field of the Invention

The invention relates to a downhole safety valve for a subterranean well, and more particularly to a safety valve utilizing electrical mechanism, controlled from the surface by electromagnetic waves, for opening and closing the valve and for locking the valve in an open position.

2. Summary of the Prior Art

The employment of a downhole safety valve is well known for subterranean oil and gas wells. Such valve, which can comprise a plug or poppet type, a sleeve valve, a flapper valve, or a ball valve, is normally positioned downhole to close the bore of the tubing string leading from one or more production zones to the well surface. Such safety valves are normally biased to a fail safe condition, i.e., energized means will shift the valve to its closed position upon any significant reduction in the opening force applied to the valve structure.

The more common type of safety valves utilizes a control fluid pressure to effect the shifting of the valve to its open positon. Such control fluid pressure is supplied through a small control conduit which is run into the well concurrently with the production tubing. Necessarily, such conduit is susceptible to damage during the run-in process, or joints in the conduit may develop leaks. In any event, the loss of integrity of the conduit will effect the immediate closing of the safety valve and the well is essentially out of operation until the entire tubing string has been pulled from the well and the necessary repairs made.

To offset the difficulties involved in the utilization of a control pressure conduit, it has been previously proposed that the downhole safety valve be actuated from its closed to its open position by a downhole solenoid which is supplied with electrical power from the surface by an electric line. The same problem of potential damage to the electric line during the run-in process exists with this arrangement and, of course, any abrasion of the insulation of the electric line during the run-in process leads to the possibility of short circuits developing in the electric line, again requiring that the entire tubing string be pulled from the well to effect the necessary repairs.

It is often necessary to run tools down through the production conduit and the open downhole safety valve to effect treatment of the production formation. Under such conditions, it is highly desirable that the safety valve be positively locked in an open position so that unexpected fluctuations in well pressure will not cause the safety valve to attempt to close when a wireline or a treatment conduit is passing through the valve. A variety of fluid pressure or mechanically actuated latching mechanisms have heretofore been proposed to effect the locking of a downhole safety valve in an open position. U.S. Pat. No. 4,579,177 discloses a solenoid actuated locking mechanism for a downhole safety valve. Such solenoid is energized by an electric line leading to the well surface, hence is subject to the problems mentioned above involved in maintaining the integrity of an electric line run into a subterranean well concurrently with production tubing.

There is a need, therefore, for a subsurface safety valve which is controllable from the surface to move from a closed to an open position, and also incorporates a locking mechanism, controllable from the well surface, for selectively maintaining the safety valve in a locked-open position, which does not depend upon the utilization of a control fluid pressure conduit or an electric line extending from the safety valve to the well surface to effect its operation.

In recent years, systems have been developed for transmitting relatively low frequency electromagnetic waves through ground or water by launching and propagating magnetic waves of generally vertical magnetic polarization through the intervening subterranean region of earth or water between a pair of magnetic dipole antennas. See, for example, U.S. Pat. No. 3,967,201 to RORDEN.

In co-pending application, Ser. No. 730,397, filed May 3, 1985, and now U.S. Pat. No. 4,736,791, entitled "Improvements in Subsurface Device Actuators," and assigned to a wholly owned subsidiary of the assignee of the instant application, there is disclosed a system for actuating a downhole safety valve between open and closed positions in response to low frequency electromagnetic waves received by a downhole antenna from a surface located transmitting antenna. Such apparatus incorporates a downhole battery but does not employ the battery for effecting the shifting of the safety valve from its closed to its open position, an act which requires a substantial amount of electrical energy. Instead, the system disclosed in such application relies upon fluid pressure to effect the shifting of the safety valve from a spring bias closed position to an open position.

Such co-pending application does, however, disclose a downhole battery and a locking solenoid selectively energized by such battery in response to electromagnetic wave signals generated by a surface transmitter. The energization of the solenoid effects the operation of a locking mechanism to secure the safety valve in its open position. Thus, while some of the disadvantages of the above described prior art systems have been overcome, the construction disclosed in the aforesaid pending application still requires the utilization of fluid pressure to effect the shifting of the safety valve to an open position.

SUMMARY OF THE INVENTION

This invention provides a downhole safety valve in a subterranean well, which has an axially shiftable actuator which is moved by an electric motor driven drive mechanism between opening and closing positions of the safety valve. The safety valve may comprise any one of the well known types, namely, a poppet valve, a sleeve valve, a flapper valve, or a ball valve, the only requirement being that such valve be capable of being opened by axial movement of an actuator. The electric motor for effecting the axial shifting of the actuator is energized by a downhole battery and the energization of the motor to rotate in either direction is selectively controlled by electromagnetic wave signals generated at the well surface.

Additionally, this invention provides a locking mechanism for effecting the locking of the safety valve in its open position. Such locking mechanism is actuated by the battery energization of a solenoid. Again, the selective energization of such solenoid is controlled by electromagnetic waves transmitted from the well surface.

Moreover, the apparatus of this invention preferably employs a fail safe means to effect the return of the safety valve from its open to its closed position, thus eliminating any drain on the battery to effect the closing stroke of the valve. The only energy required to maintain the valve in its locked open position is that required by the solenoid which is minimal, due to the fact that the armature of the solenoid only has to retain a relatively light weight latch retaining sleeve in engagement with collet arms which are lockingly engaged with the actuator for the safety valve. Thus, the necessity of providing a continuous high current to maintain the safety valve in an open position has been eliminated.

Lastly, a pressure equalizing mechanism is provided for the safety valve which is actuated by the initial axial movement of the actuator from its valve closing position.

Thus, the method and apparatus of this invention provides a conveniently controllable downhole safety valve which may be selectively opened or closed by electromagnetic waves transmitted from the well surface and eliminates the necessity of running either control fluid conduits or electric wires into the well solely for the purpose for controlling the operation of the safety valve.

Further objects and advantages of the invention will be readily apparent to those skilled in the art from the following detailed description, taken in conjunction with the annexed sheets of drawings, on which is shown a preferred embodiment of the invention.

DESCRIPTION OF PREFERRED EMBODIMENT

Figure 1:
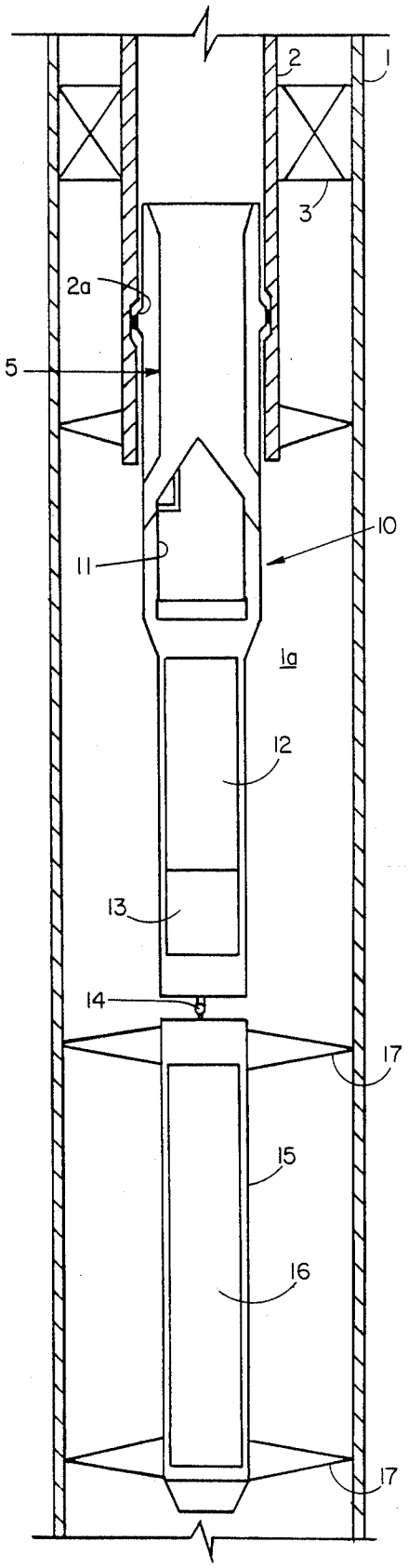
FIG. 1 is a schematic vertical sectional view of a safety valve embodying this invention shown in its installed position within a production conduit of a subterranean well.

Referring first to the schematic view of FIG. 1, a housing 10 for a safety valve embodying this invention is shown installed in the bottom end of production tubing 2 which is run into a well casing 1. The annulus la between the production tubing 2 and the well casing 1 is sealed by a conventional packer 3. The safety valve housing 10 may be suspended in the bottom end of the production tubing string 2 by any type of conventional latching mechanism 5 which cooperates with an internal recess **2*a* formed in the production tubing 2**.

Safety valve housing 10 incorporates a safety valve mechanism 11, a battery case 12, and an electronic signal converter unit 13. An antenna housing 15 is flexibly connected to the bottom end of the safety valve housing 10 by a conventional flex joint 14 and houses an antenna 16. The antenna housing 15 is maintained in a fixed axially aligned position relative to the axis of casing 1 by a pair of stabilizing units 17 respectively mounted at either end of the antenna housing 15.

Figure 4:
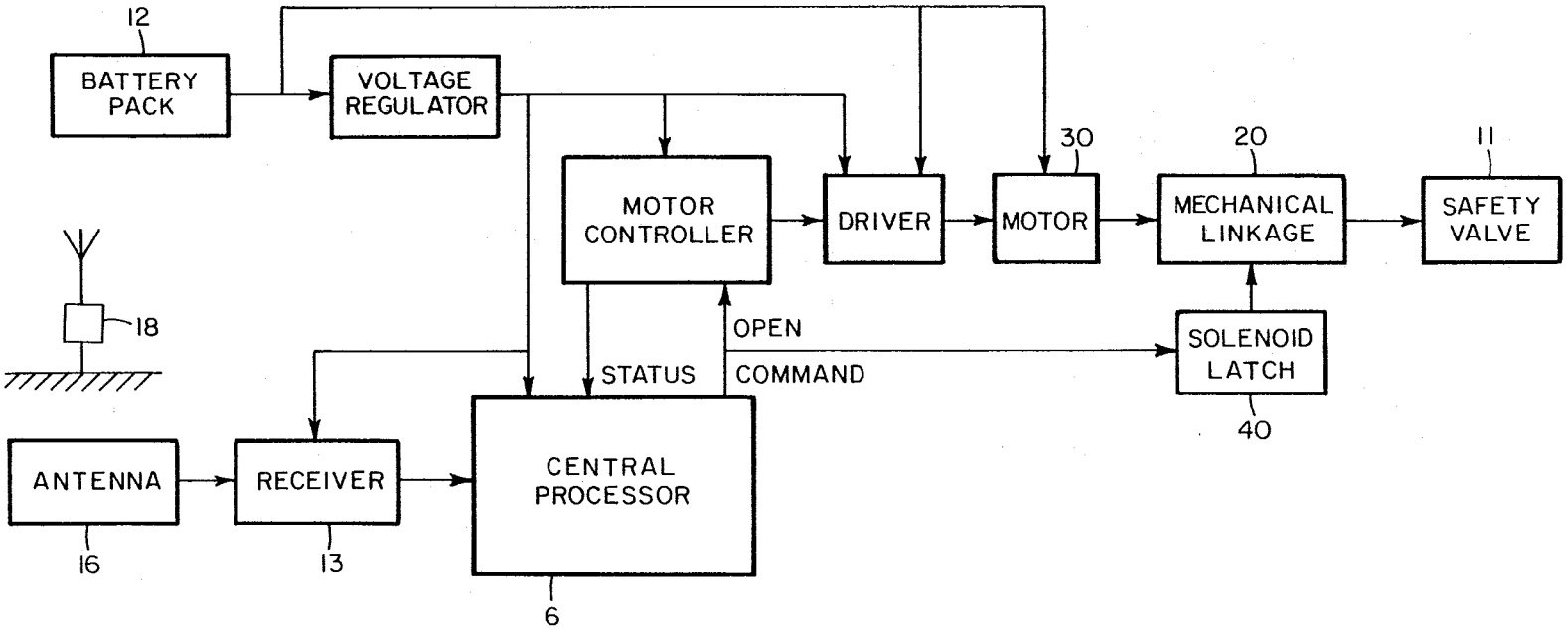
FIG. 4 is a schematic diagram of the control circuit for the safety valve embodying this invention.

As best shown in the schematic circuit diagram of FIG. 4, a surface mounted electromagnetic wave transmitter 18 transmits an electromagnetic signal downwardly through the earth which is received by antenna 16 and supplied to an electronic receiver unit 13. The transmitter 18 and receiving antenna 16 may be of the type described in said co-pending application Ser. No. 730,397. Electronic unit 13 receives and amplifies the received signal and supplies it to a central processor unit 6. Processor 6 in turn controls the supply of energy from the batteries in battery case 12 to a motor 30 for effecting the shifting of a safety valve actuator 20 between open and closed positions. Additionally, the processor unit 6, in response to a second signal carried by the electromagnetic waves generated by transmitter 18 selectively applies energy to a solenoid latch 40 (hereinafter described) to selectively effect the locking of the safety valve 11 in an open position.

Referring now to FIGS. 2A, 2B, 2C, 2D, 2E, 2F, 2G, 2H, 2I, 2J, 2K and 2L the detailed mechanism constituting the apparatus of this invention will be described.

Figure 2A:
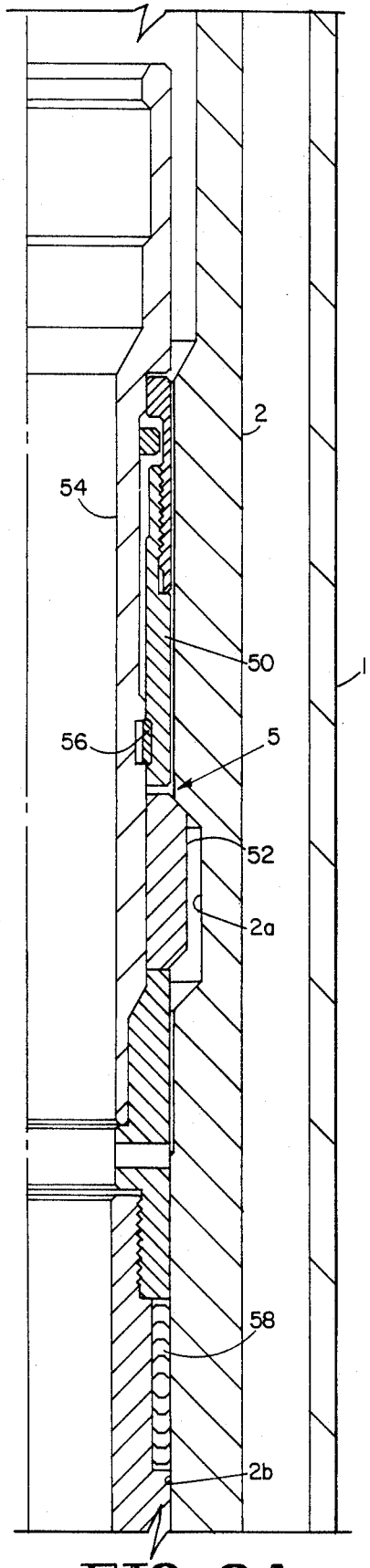
FIGS. 2A, 2B, 2C, 2D, 2E, 2F, 2G, 2H, 2I, 2J, 2K and 2L collectively constitute a schematic vertical sectional view illustrating the detailed construction of a safety valve embodying this invention installed in a subterranean well, with the elements of the safety valve shown in their closed position.
Figure 3A:
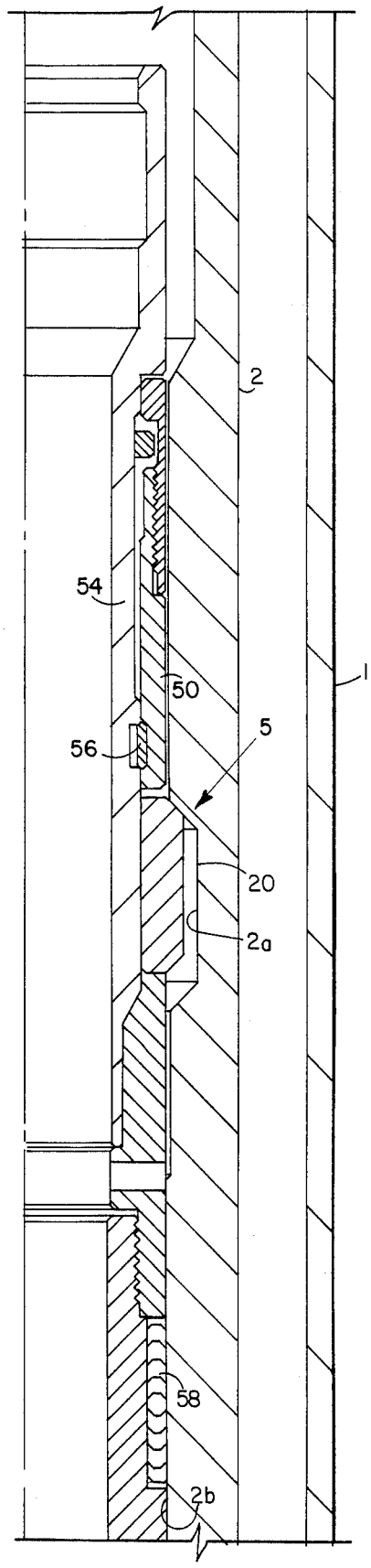
FIGS. 3A, 3B, 3C, 3D, 3E, 3F, 3G, 3H, 3I, 3J, 3K, and 3L are views respectively similar to FIGS. 2A, 2B, 2C, 2D, 2E, 2F, 2G, 2H, 2I, 2J, 2K and 2L but showing the elements of the safety valve in their locked open position.
Figure 2B:
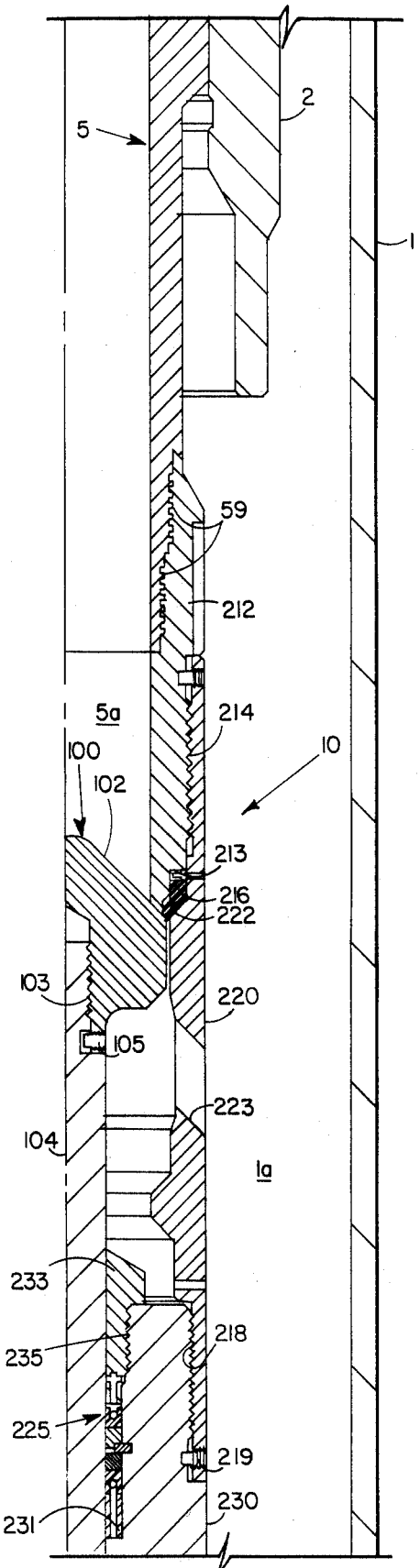

Referring specifically to FIGS. 2A and 2B, the safety valve housing 10 is secured within the bottom end of production tubing string 2 by a conventional latching mechanism 5 including a tubular latching body 50 in which are mounted a plurality of peripherally spaced, radially shiftable latching dogs 52 which are respectively held in engagement with an internal recess **2*a* in production tubing 2 by a wireline actuated sleeve 54. When the latch 5 is engaged, the sleeve 54 is secured to the body 50 by a C-ring type locking ring 56. Additionally, an external seal 58 is provided on the lower portions of the latching mechanism 5 to provide sealing engagement with the bore 2*b* of the production tubing string 2. Since the latching mechanism 5** is entirely conventional, further description thereof is believed unnecessary.

Latching mechanism 5 is provided at its bottom end with external threads 59 which are respectively engaged by internal threads provided on a connecting sub 212. Connecting sub 212 is provided with external threads 214 which are threadably engaged by internal threads formed on a seal retainer sleeve 220. Seal retainer sleeve 220 traps an annular non-elastomeric sealing element 216 between an upwardly facing shoulder 222 formed on the seal retainer 220 and a downwardly facing shoulder 213 formed on the connecting sub 212.

Figure 3B:
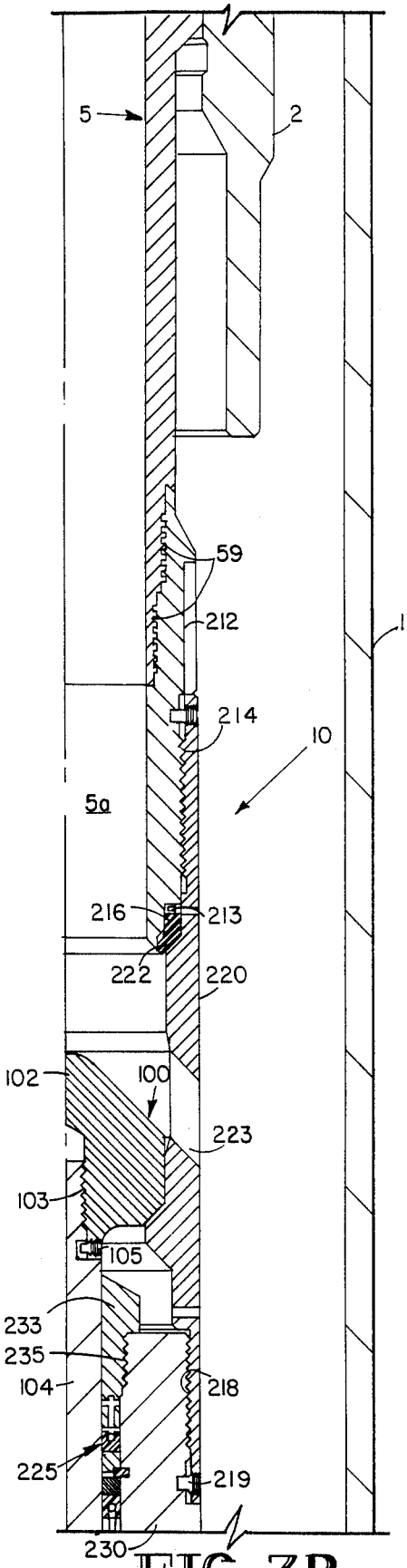

A conical valve head 102 forming part of a plug-type valve unit 100 sealably engages the non-elastomeric seal element 216 to achieve a closing of the bore of the latching mechanism 5, thus closing the bore **5*a* of the production tubing string 2. The conical valve head 102 is secured by internal threads 103 to the top end of a rod-like actuator 104, and actuator 104 is spring biased by a spring 226 (FIG. 2C) to the closed position of the valve head 102 relative to the annular seal 216, as will be later described in detail. A set screw 105 secures the threaded engagement between valve head 102 and actuator rod 104. Below the annular seal 216, the seal retaining sleeve 220 is provided with a plurality of peripherally spaced, inclined, radial ports 223 which provide for free communication between the tubing casing annulus 1*a* and the bore 5*a* of latching mechanism 5** when valve head 102 is shifted downwardly to its open position, as shown in FIG. 3B.

The lower end of seal retaining sleeve 220 is provided with internal threads 218 which are secured to a tubular spring housing 230 and secured by set screw 219. At its lower end, the spring housing 230 mounts a C-type retaining ring 232 (FIG. 2C) which in turn secures an annular abutment ring 234 in position to support the bottom end of a power spring 226. Abutment ring 234 is provided with a plurality of axially extending openings 235 to permit free fluid flow into the annular chamber 238 defined between the inner wall of the spring housing 230 and the external cylindrical surface of the actuator rod 104. A top spring seat ring 106 abuts against a downwardly facing shoulder 105 provided on the external surface of the actuator rod 104. Spring seat 106 is engaged by the upper end of the power spring 226 and is provided with a plurality of axially extending apertures 108 to permit free fluid flow from spring chamber 238.

A conventional internal seal and bearing structure 225 is mounted on the upper end of the spring housing 230 by being positioned between an upwardly facing shoulder 231 provided on the inner surface of spring housing 230 and the downwardly facing end surface of an annular plug 233 which is secured to external threads 235 formed on the top inner surface of the spring housing 230. Thus, the actuator rod 104 for the valve unit 100 is slidably and sealably mounted in the tool for axial movements relative to the annular valve seat 216 and is held in a fail-safe closed position by the power spring 226.

The spring housing 230 is further provided at its lower end with two sets of external threads 237 and 239. (FIG. 2C) External threads 237 cooperate with internal threads formed on the top end of a main housing 250 and are sealed by seal ring 241. The external threads 239 cooperate with internal threads provided on the top end of a motor mounting sleeve 240.

Figure 2C:
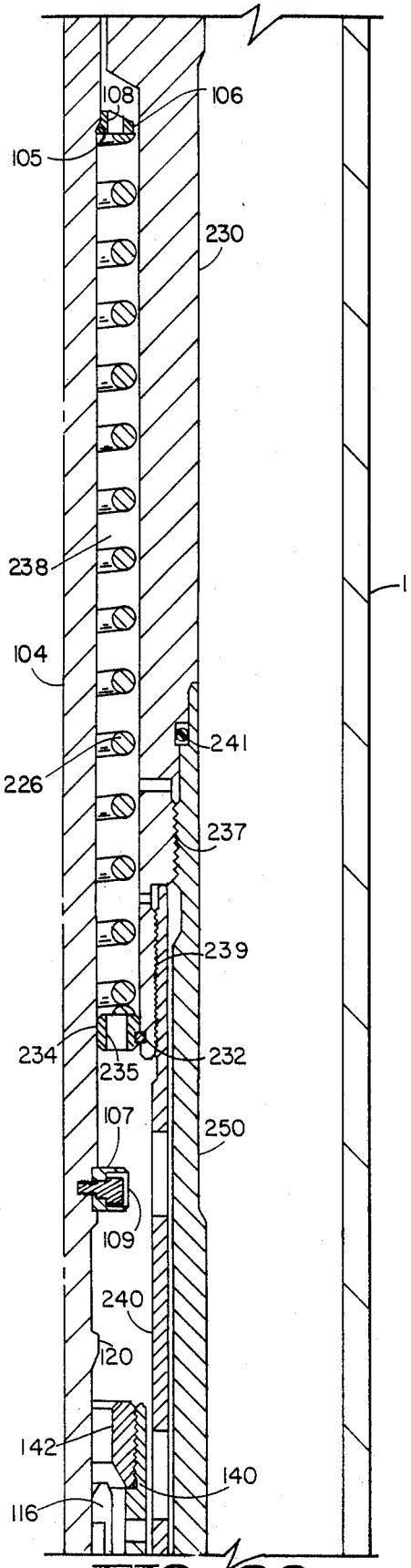
Figure 2D:
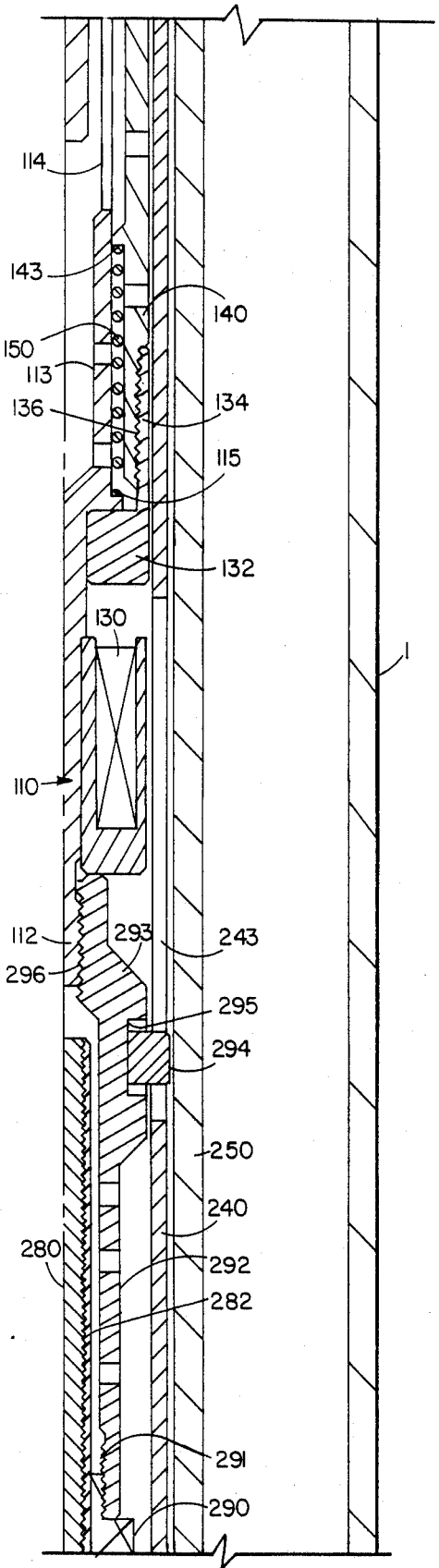
Figure 2E:
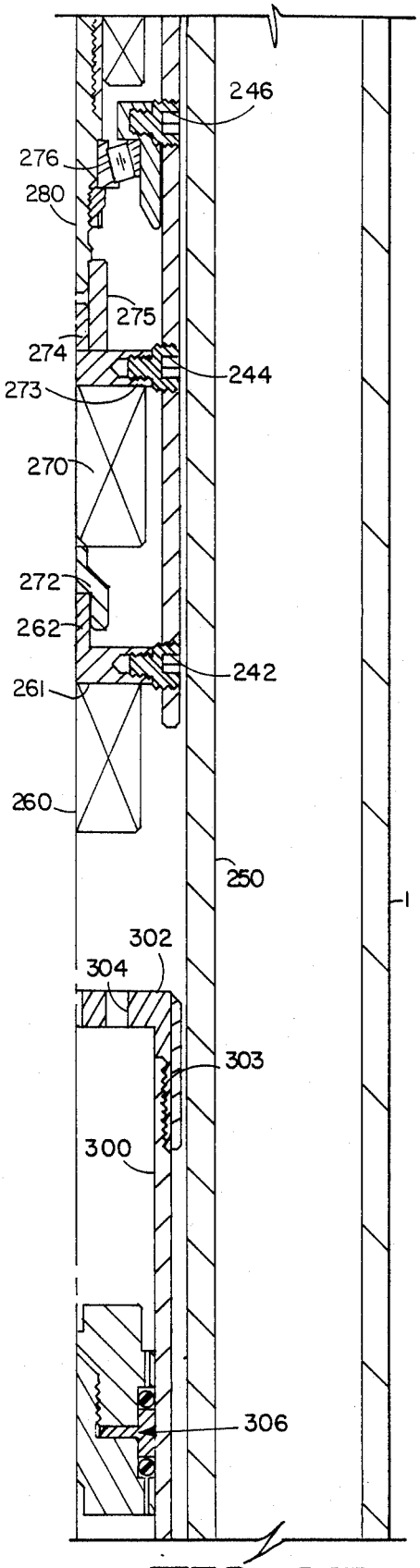
Figure 3E:
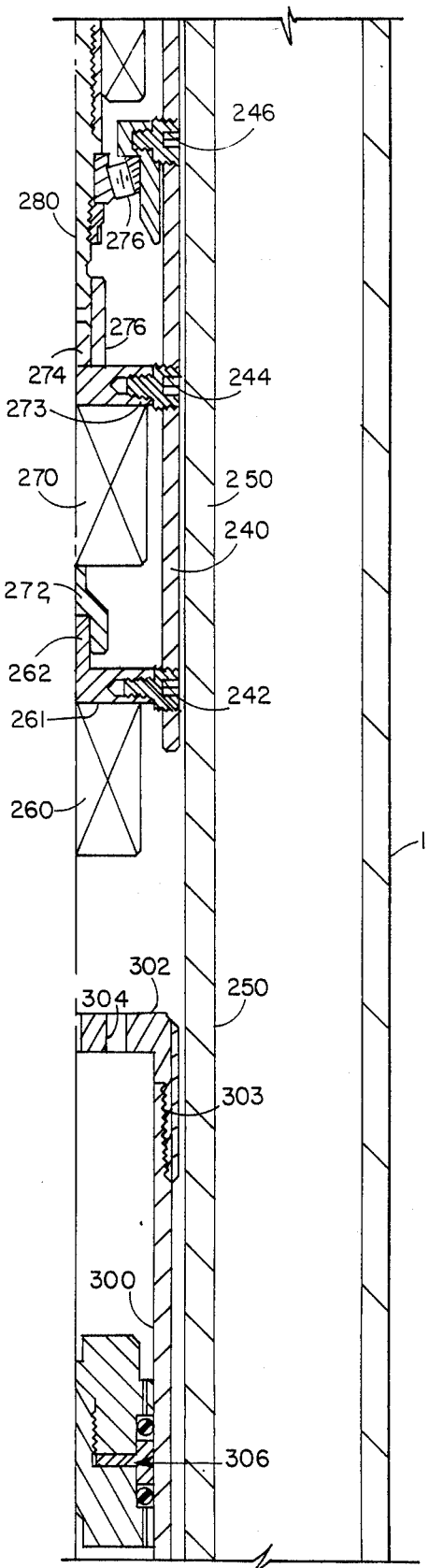
Figure 2F:
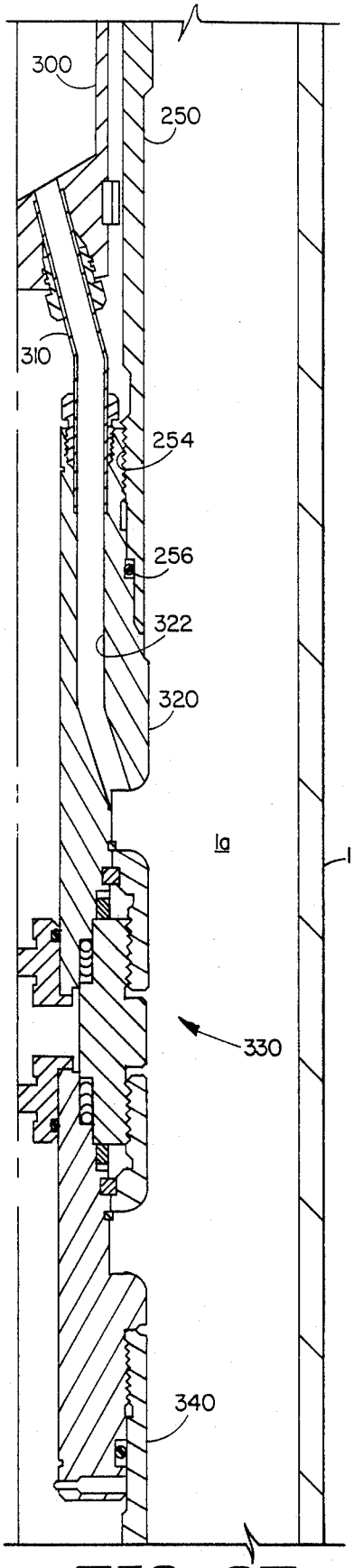
Figure 3F:
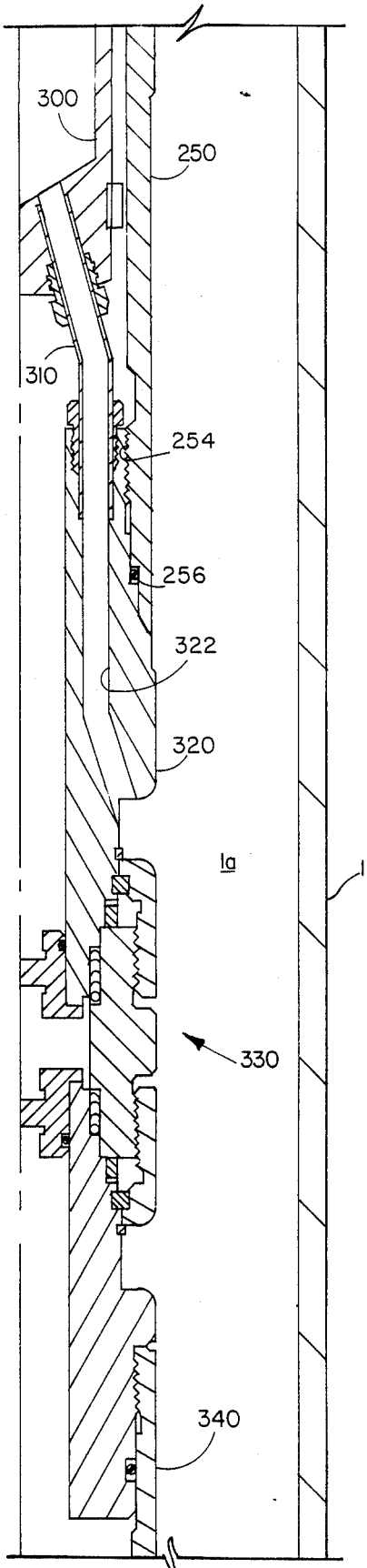
Figure 2G:
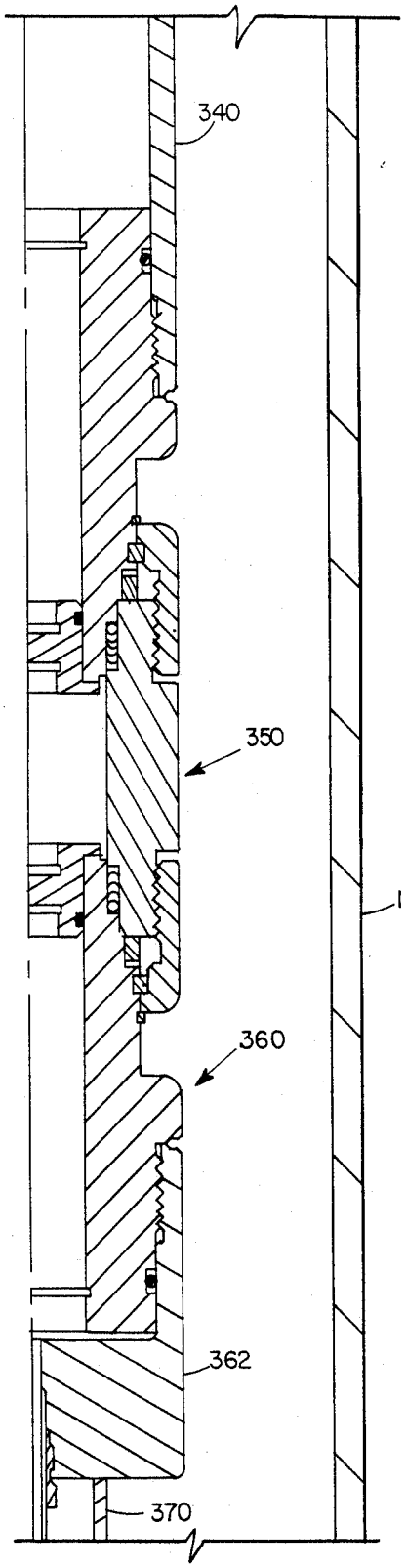
Figure 3G:
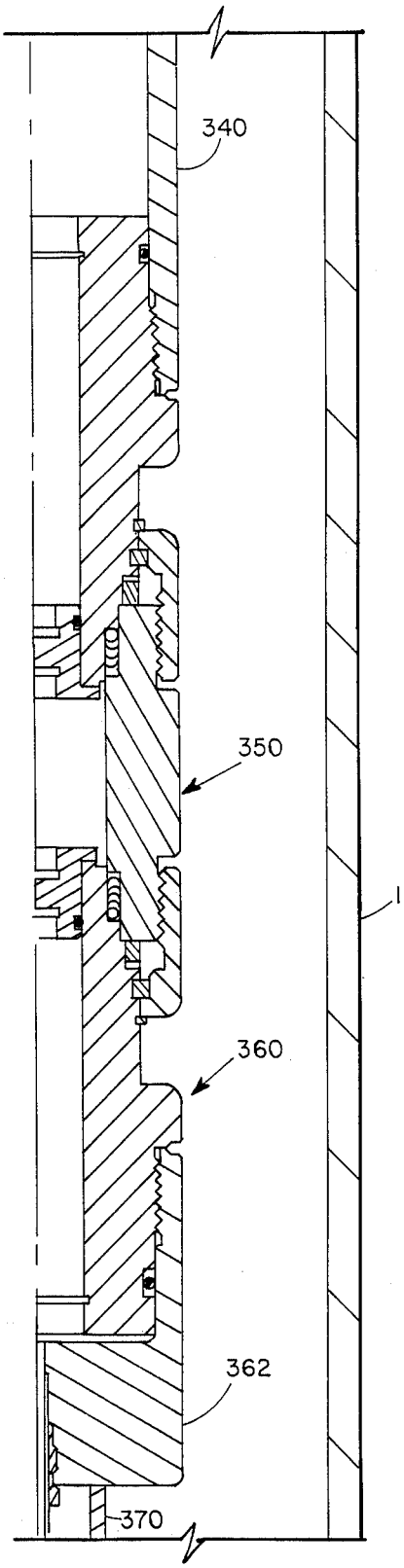

The motor mounting sleeve 240 extends downwardly a substantial distance, and, at its bottom end, shown in FIG. 2E, supports a fluid submersible reversible electric stepping motor 260 which is only shown schematically. Motor 260 has an externally projecting mounting flange 261 which is secured to the motor mounting sleeve 240 by a plurality of peripherally spaced, radially disposed bolts 242.

The output shaft 262 of the stepping motor 260 is connected to the input shaft 272 of a conventional gear reduction unit 270 which has a peripherally extending mounting flange 273 by which it is secured to the motor mounting sleeve 240 by a plurality of peripherally spaced bolts 244. Again, this is a conventional unit and is only shown schematically.

The output shaft 274 of the gear reduction unit 270 is connected by a coupling sleeve 275 to the bottom end of an externally threaded, axially extending screw element 280. A conventional ball or roller bearing unit 276 mounts the screw 280 for rotation and the bearing unit 276 is secured to the motor mounting sleeve 240 by a plurality of peripherally spaced bolts 246.

The external threads 282 provided on the screw 280 cooperate in conventional fashion with threads, or preferably balls, provided in a ball nut unit 290. Thus, rotation of the screw 280 will produce an axial displacement of ball nut unit 290.

A guide sleeve 292 is secured to the top end of ball nut unit 290 by threads 291. Guide sleeve 292 is provided with a radially thickened portion 293 within which one or more keys 294 are mounted in a suitable recess 295. Keys 294 project radially outwardly into a vertically extending slot 243 provided in the wall of the motor mounting sleeve 240. Thus, the ball nut 290 is secured against rotation and hence moves axially when the screw 280 is rotated by motor 260.

Figure 3C:
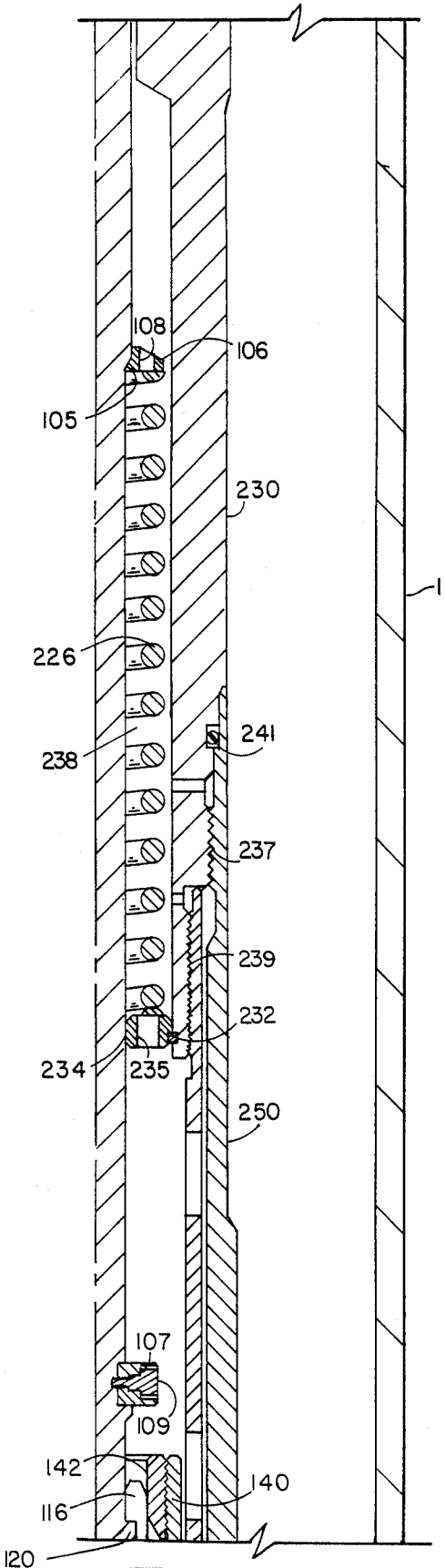
Figure 3D:
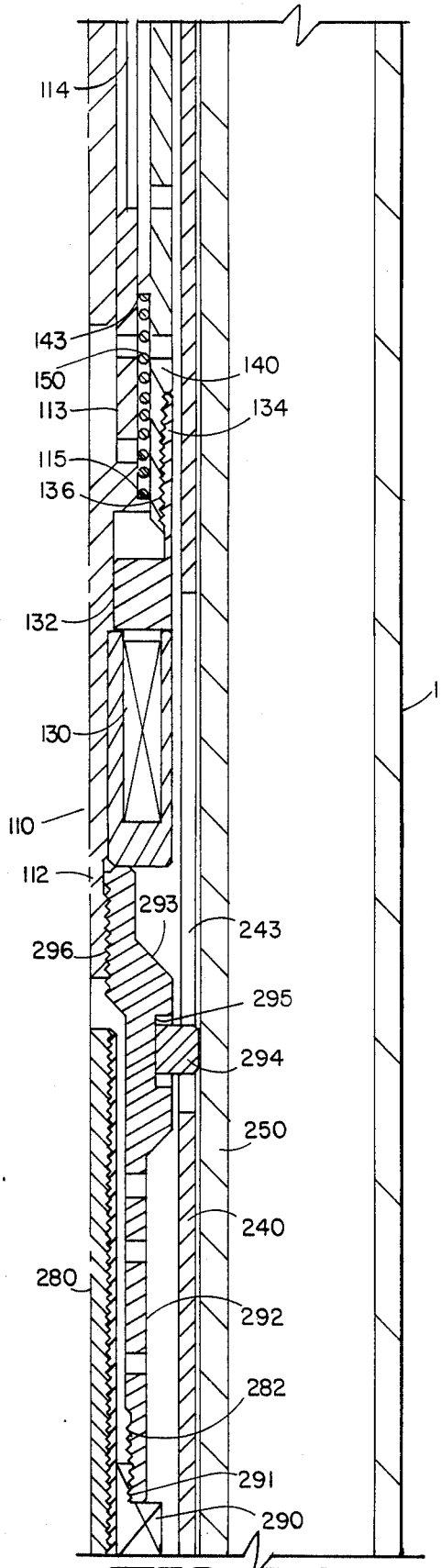

The top end of the actuating sleeve 292 is provided with internal threads 296 which engage external threads provided on the lower rod portion 112 of a force transmitting collet 110. The upper end 113 of the collet 112 is of tubular configuration and is provided with a plurality of peripherally spaced, flexible arm portions 114, each of which teminates in an inwardly enlarged head portion 116 (FIG. 2C). The head portions 116 are normally disposed below an external locking rib 120 formed on the exterior of the actuating rod 104 when such rod is in the closed position of the valve as shown in FIG. 2C. Upward movement of the collet 110 will produce an engagement of the collet heads 116 with the locking rib 120 and hence permit the actuating rod 104 to be pulled downwardly by downward movement of the collet 110 produced by the actuating sleeve 292, as shown in FIG. 3D.

Immediately above the top end of the actuating sleeve 292, a fluid immersible, electric solenoid 130 is mounted. Such solenoid is shown only schematically and is provided with a ferromagnetic annular armature 132 which has an upwardly extending sleeve portion 134 provided with internal threads 136. A latching sleeve 140 has external threads provided on its bottom end cooperating with internal threads 136 and defines an internally projecting, downwardly facing spring seat 143. A relatively light compression spring 150 is compressed between spring seat 143 and an external shoulder 115 provided on collet 110. Thus, the locking sleeve 140 and the armature 132 are biased to an upward position relative to the solenoid 130. When the solenoid 130 is energized, the armature 132 will be shifted downwardly into engagement with the top end of such solenoid and this downward axial movement of the latching sleeve 140 moves a latching head 142 (FIG. 2C) secured to the top end of latching sleeve 140 into abutting engagement with the outer walls of the collet arms 114, thus securing the collet locking heads 116 in engagement with the locking rib 120 provided on the actuating rod 104. This assumes, of course, that the electric motor 260 has been energized to rotate first in a direction to bring the collet latching heads 116 upwardly to a position above the locking rib 120 on the actuator rod 104. It will be noted that a stop ring 107 is secured to the external periphery of actuator rod 104 by set screws 109 to limit the upward movement of the actuating collet 110. It should also be noted that the solenoid 130 moves upwardly with the collet 110, thus not affecting the position of the latching sleeve 140 relative to the collet locking heads 116 until solenoid 130 is energized.

The operation of that portion of the mechanism 11 of the safety valve 10 heretofore described will be readily apparent. Assuming that the safety valve is in its normal closed position, the electric motor 260 is energized from a suitable source of electricity, preferably a downhole battery, as will be described, to move the collet 110 upwardly and thus position the collet locking heads 116 above the locking rib 120 formed on the actuator rod 104. When the motor stalls out due to contact of the latching sleeve with the stop ring 107, an electrical signal will be generated which will effect the de-energization of the electric motor 260. The electric motor 260 is then energized to rotate in the opposite direction, thus bringing the collet 110 downwardly and engaging the latching heads 116 with the locking rib 120 on the actuator rod 104. Concurrently therewith, the solenoid 130 is energized, thus moving the ferromagnetic armature 132 downwardly and effecting a downward displacement of the latching sleeve 140 relative to the collet 110 to bring the latching head 142 into abutting engagement with the collet locking heads 116, thus securing the locking heads to the actuator rod 104 and assuring that the actuator rod 104 will be moved downwardly to the open position shown in FIG. 3D. The electric motor 260 may be de-energized without affecting the position of the actuator rod 104 since it is locked in position by the locking sleeve 140. Subsequent de-energization of the solenoid 130 will permit the armature 132 to be moved upwardly by the spring 150 and this will move the latching head 142 out of abutting engagement with the collet locking heads 116, permitting such collet locking heads to release from the locking rib 120 on the actuator rod 104, hence permitting the actuator rod 104 to be driven upwardly by the power spring 226 to return the valve head 102 to its closed, sealed position with respect to the annular seal 216.

In the preferred embodiment of the invention, the energization and de-energization of the electric motor 260 and the latching solenoid 130 are respectively controlled by electromagnetic wave signals transmitted from a surface transmitter and received by the downhole antenna 16. FIGS. 2E, 2F, 2G, 2H, 2I, 2J, 2K and 2L indicate the preferred apparatus for effecting the energization and control of these downhole electrical elements. To minimize friction, and to provide a noncorrosive environment, the motor 260, the gear box 270, the ball nut screw 280, the ball nut 290 and all of the valve actuating structure thereabove, up to the seal unit 225 (FIG. 2B), are preferably surrounded with an appropriate oil having both lubricating and insulating properties. A seal 256 (FIG. 2F) at the bottom of main housing 250 and seal 241 (FIG. 2C) at the top of main housing 250 cooperate with seal assembly 225 to provide a chamber for such oil which may be inserted through a plugged hole (not shown). Such oil will undergo a substantial expansion due to temperature change as the mechanism is lowered into the well. For this reason, a pressure compensating cylinder 300 (FIG. 2E) is mounted in the lower end of the main housing 250. Cylinder 300 has an upper end cap 302 secured thereto by threads 303 and having a plurality of axially extending holes 304 extending therethrough to permit the lubricating fluid to freely enter the interior of the pressure equalizing cylinder 300. A conventional piston 306 is slidably and sealably mounted within the bore of the pressure compensating cylinder 300. The lower end of cylinder 300 has a pipe 310 (FIG. 2F) sealably secured thereto and communicating with a bore 322 provided in a connecting sub 320, which bore extends to the casing annulus 1*a*. Since the connecting sub 320 is threadably secured to internal threads 254 provided in the bottom end of main housing 250 and the threaded connection is sealed by seal 256, it will be apparent that any increase in fluid pressure within the space defined by the main housing 250 will result in a downward displacement of the pressure compensating piston 306 and the pressure is relieved by exhausting well fluid below the piston 306 through the conduit 322 to the casing annulus.

A conventional threaded and sealed connection mechanism 330 is provided between the bottom end of the connecting sub 320 and the top end of a tubular battery module 340. The batteries are not shown in the drawings.

The bottom end of battery module 340 is threadably and sealably connected through a conventional connecting mechanism 350 to the top end of an electronic module 360 which contains the receiver, central processor, motor controller and driver schematically shown in the circuit diagram of FIG. 4.

Figure 2H:
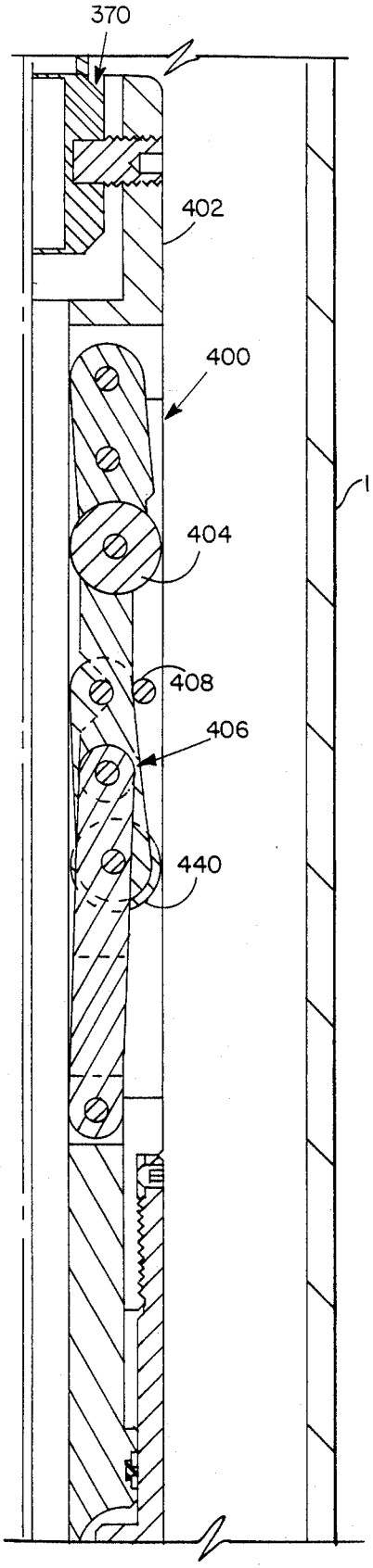
Figure 3H:
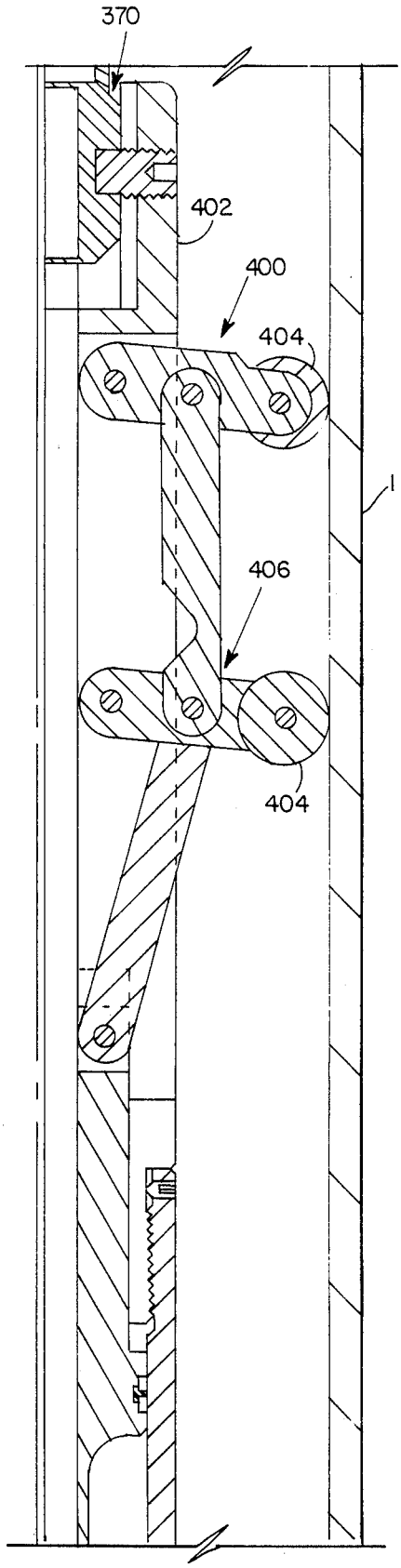
Figure 2I:
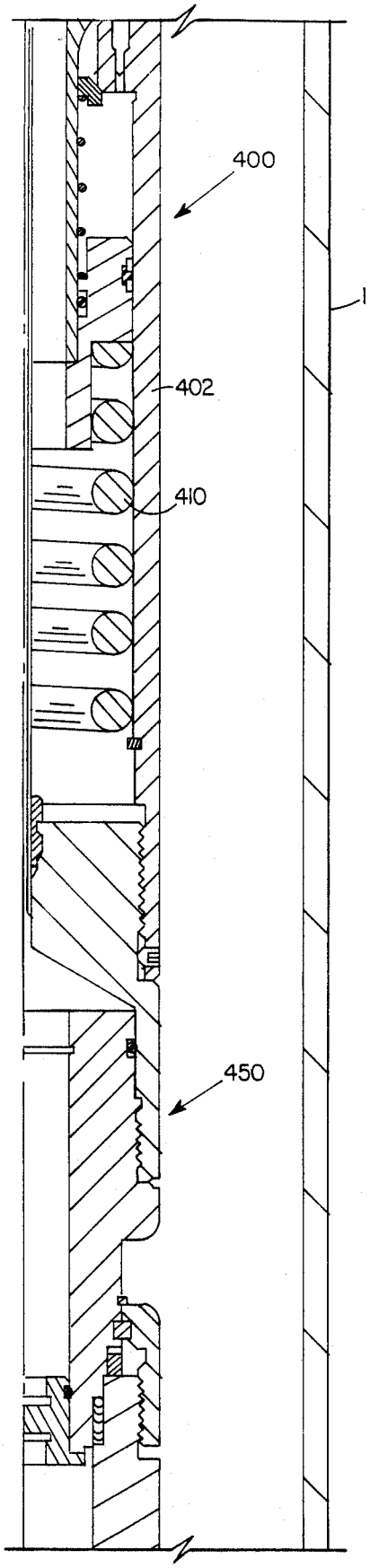
Figure 3I:
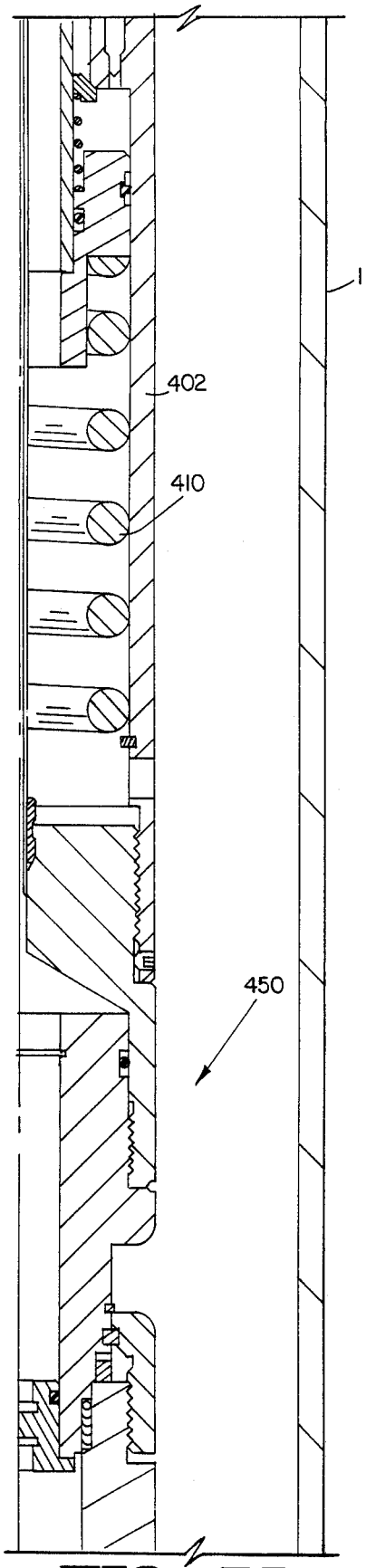
Figure 2J:
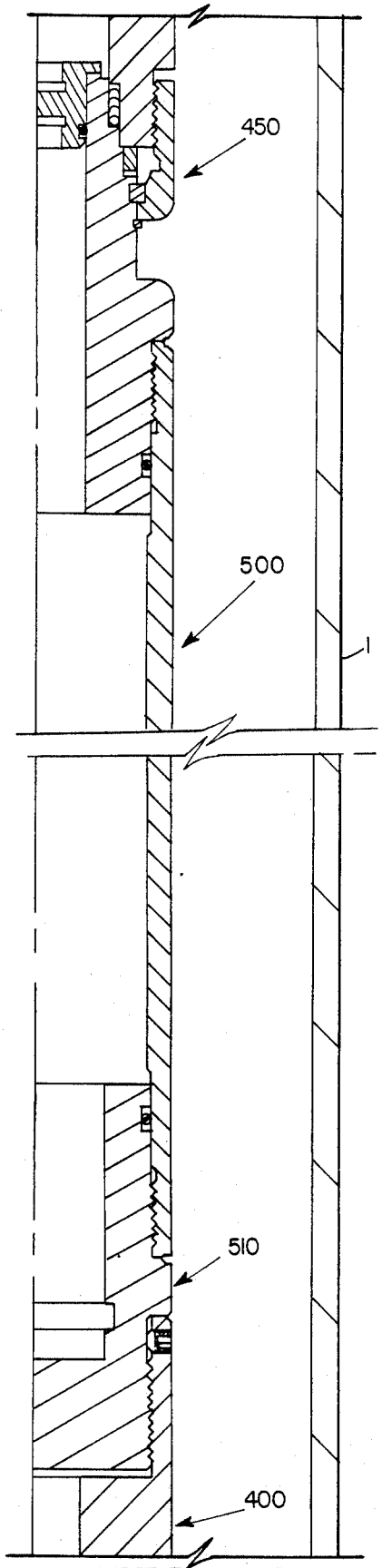
Figure 3J:
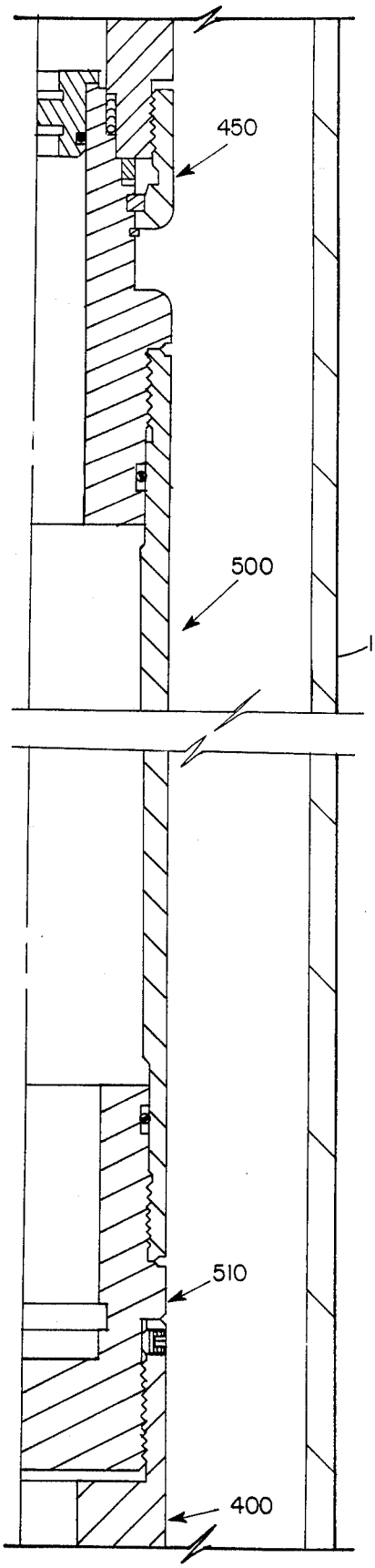
Figure 2K:
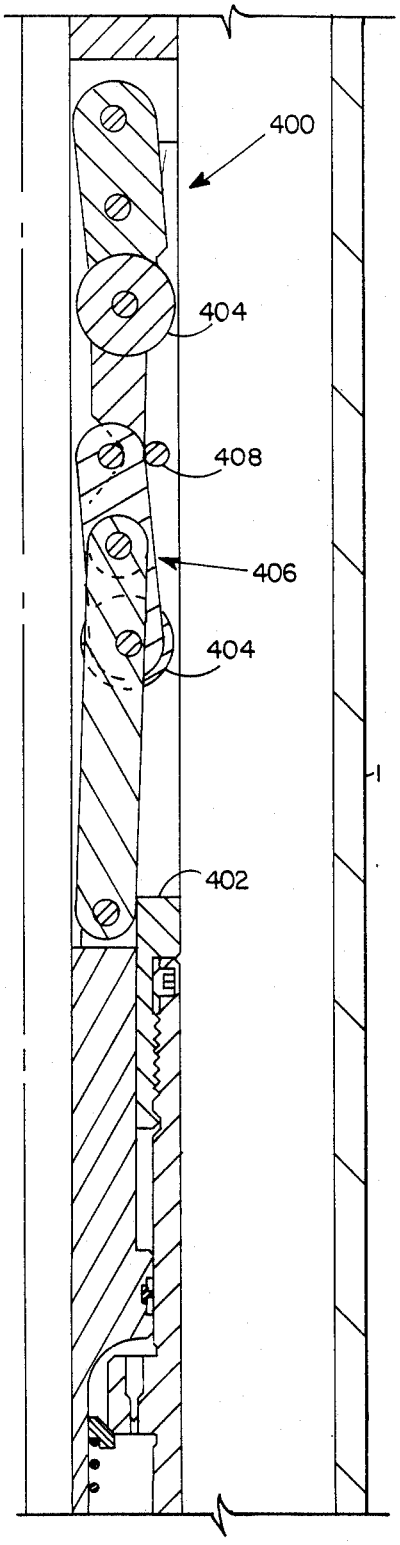
Figure 3K:
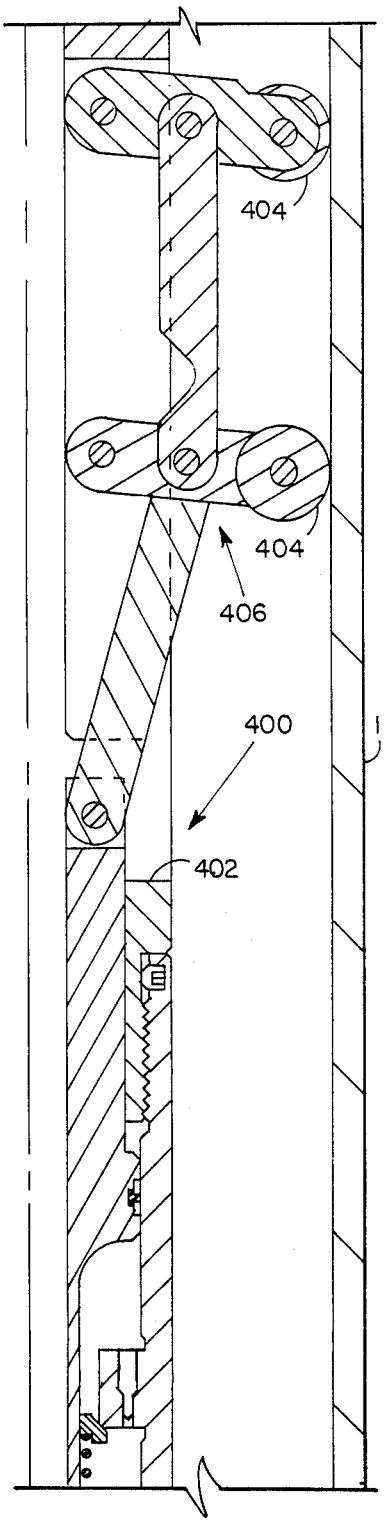
Figure 2L:
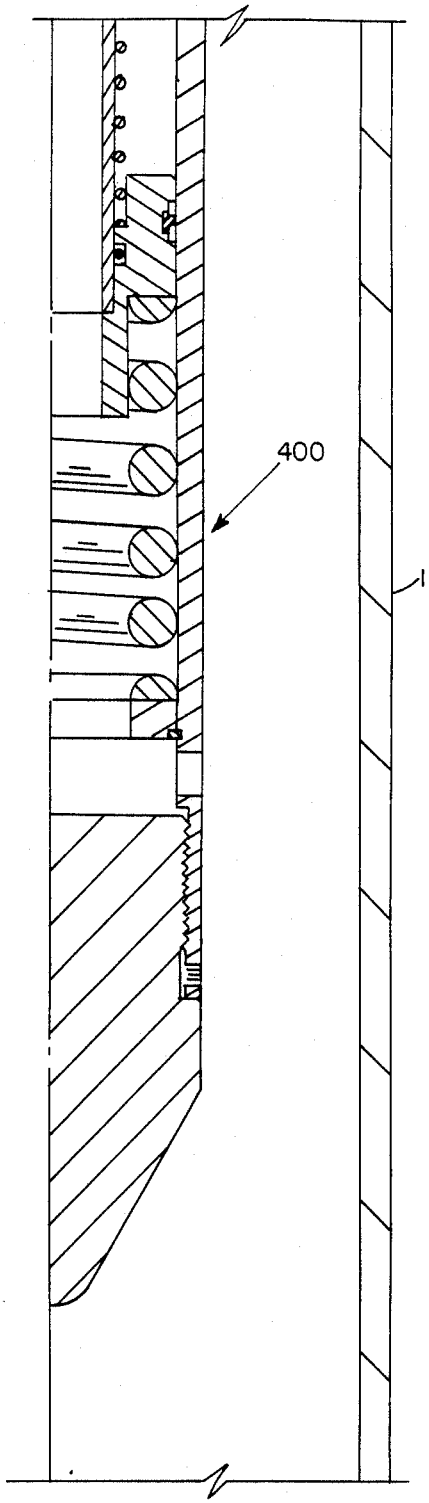
Figure 3L:
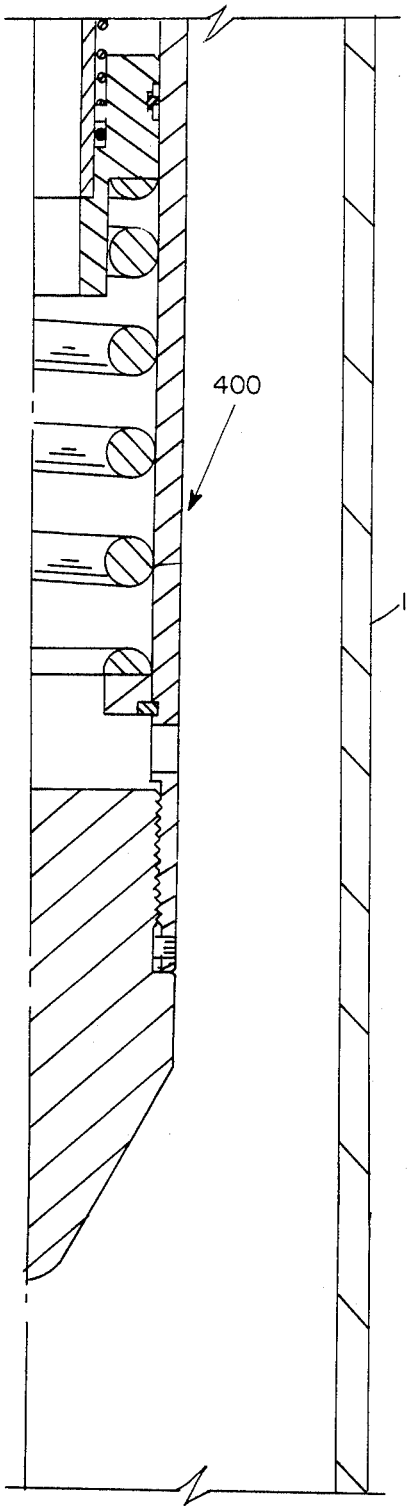

The bottom end of the electronics module 360 is provided with an end cap 362 and such end cap is connected by a conventional flexible or universal joint 370 to the top end of a housing 402 forming part of a stabilizer unit 400. Stabilizer unit 400 is shown and described in detail in co-pending application Ser. No. 164,867, filed concurrently herewith and assigned to the assignee of the instant invention. Such disclosure is hereby incorporated in this application by reference and will not be described in detail. In the run-in position of the stabilizer unit 400, a plurality of peripherally spaced, radially expandable linkages 406 are provided on housing 402. Each linkage 406 mounts a pair of axially spaced antifriction rollers 404 which are held in a radially retracted position as shown in FIG. 2H, during run-in. Such linkage is expanded to a radially expanded position by the melting of a fusible pin 408 which is meltable when exposed to the well temperatures existing at the depth of insertion of the safety valve 10. When pin 408 melts, the rollers 404 move out to a radially expanded position under the bias of spring 410 and engage the bore wall of the well casing 1, as shown in FIG. 3H.

The bottom end of stabilizer housing 402 is threadably and sealably secured through a conventional connection mechanism 450 to the top end of a tubular antenna module 500 in which the dipole antenna 16 (FIG. 4) is conventionally mounted.

The bottom end of antenna module 500 is threadably and sealably connected to the top end of a second stabilizer unit 400 which is identical to the upper stabilizer unit 400 previously described. Thus, both ends of the antenna module 500, when the stabilizer units have been radially expanded, are held in a rigid position in exact concentric relationship to the axis of the well conduit 1. Through the use of the two axially spaced stabilizer units 400, it is thereby assured that fluctuations in fluid velocity passing the exterior of the antenna module 500 will not produce any form of vibration of such module, thus eliminating the possibility of generation of a noise signal which would interfere with the control signals transmitted to the antenna 16 from a surface transmitter 18, as shown by the schematic circuit diagram of FIG. 4.

Figure 5A:
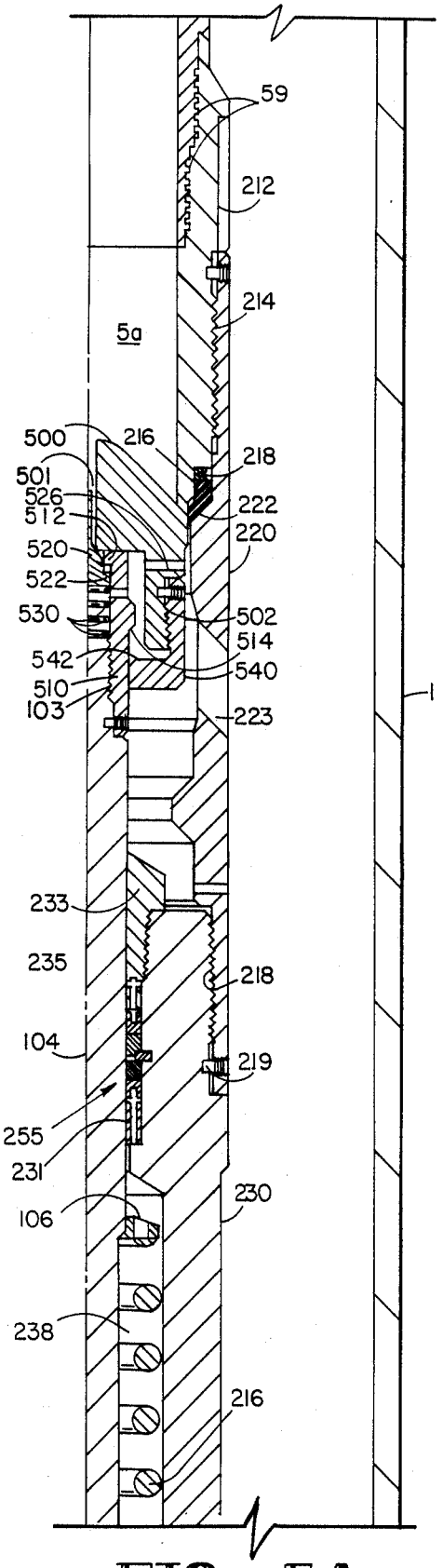
FIG. 5A is a sectional view of a safety valve embodying this invention and incorporating a pressure equalizing feature with the valve in its closed position.

Referring now to FIG. 5, there is shown a modified safety valve embodying this invention which incorporates a pressure equalizing feature. Those skilled in the art will recognize that it is desirable that the fluid pressures existing above and below the valve head be equalized prior to effecting axial movement of the valve head relative to the annular seal. In FIG. 5, where similar numerals indicate parts similar to those previously described, the conical valve head 500 is not directly connected to the actuating rod 104 as in the previously described modification. Instead, the connection of valve head 500 is effected through a lost motion connection.

Thus, a lost motion connecting sleeve 510 is threadably secured to threads 103 on the top end of the actuator rod 104. Lost motion connecting sleeve 510 has an internally projecting rib 512 at its upper end which is engagable with an external rib 522 formed on a valve plug 520 which, in the closed position of the valve head 500 closes a small central bore 501 formed in such valve head. Valve plug 520 is urged to a closing position by a compression spring 530 which is compressed between the valve plug 520 and the top end of actuator rod 104. The lost motion connecting sleeve 510 is provided with an external rib 514 which, after limited downward movement of the actuator rod 104 sufficient to pull the valve plug 520 out of the bore 501 of the valve head 500 engages an internally projecting shoulder 542 formed on the end of a sleeve 540 which is secured to external threads 502 formed on the lower portion of the valve head 500. Additionally, the valve head 500 is provided with one or more radial passages 526 which provide a fluid connection between the valve head bore 501 and the casing annulus 1*a* through the inclined radial passages 223.

Figure 5B:
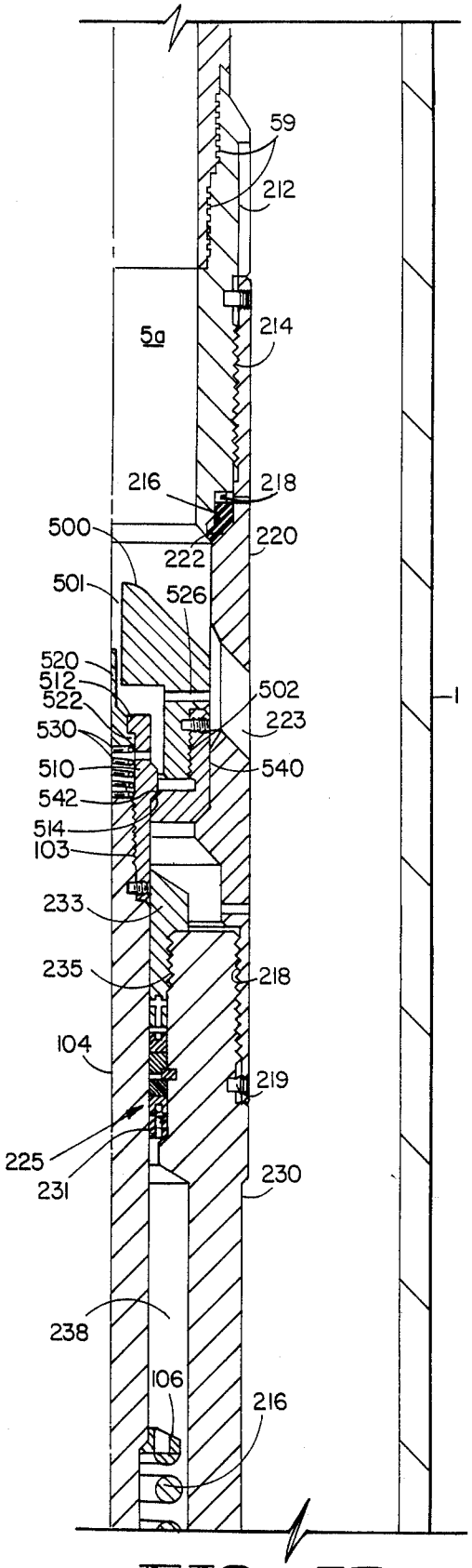
FIG. 5B is a view similar to FIG. 5A but with the valve shown in its open position.

The operation of this modification of the invention will be readily understood by those skilled in the art. In the closed position of the valve illustrated in FIG. 5A, the bore 501 of the valve head 500 is closed by the valve plug 520 which is urged to its closed position by the compression spring 530. Initial downward movement of the actuator rod 104 will pull the valve plug 520 downwardly by lost motion sleeve 510 to open the bore 501 to fluid flow to the casing annulus, thus equalizing the fluid pressures above and below the valve head 500 before the valve head 500 is moved from its sealing engagement with the annular seal ring 216. Further downward movement of the actuating rod 104 will bring the external shoulder 514 on the connecting sleeve 510 into engagement with the internally projecting shoulder 542 on the sleeve 540 and effect downward movement of the valve head 500, thus completely opening the bore of the tubing string to communication with the casing annulus, as shown in FIG. 5B.

From the foregoing description, it will be readily apparent to those skilled in the art that this invention provides a unique mechanism for effecting the shifting of a safety valve, spring biased to a closed position, to an open position by a downhole electric motor energized by downhole batteries. The invention also provides a solenoid actuated latching mechanism for locking the safety valve in an open position, thus eliminating current drain on the batteries except for that required to hold the solenoid actuated latch in its collet engaging position. The current drain on the downhole batteries is thus significantly reduced.

It is also readily apparent that a surface source of electricity could be employed to effect the energization and de-energization of the downhole motor and the latching solenoid, and the invention is not to be construed as limited to use with a downhole battery as the source of energy.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. Apparatus for shifting a downhole tool axially shiftably mounted in a subterranean well conduit for movement between an initial and a second position comprising, in combination: an axially extending actuator connected at one end to said downhole tool; resilient means opposing axial movement of said actuator in the direction away from said initial position; peripheral abutment means on said actuator; shifting means disposed adjacent said actuator; an axial force transmitting member in operative engagement with said shifting means; means for mounting said force transmitting member for non-rotatable axial movement relative to said conduit; an electric motor fixedly mounted in said conduit; and threaded means rotatable by said electric motor and threadably engagable with said force transmitting member to axially shift said shifting means and said actuator in the direction opposed by said resilient means and thereby position the downhole tool in said second position.

2. The apparatus defined in claim 1 wherein said downhole tool comprises a valve having an open and a closed position relative to the bore of the well conduit; said resilient means opposing movement of said valve from said closed position.

3. The apparatus of claim 1 further comprising a latch sleeve axially movable relative to the well conduit; said latch sleeve having locking surfaces movable to a position in engagement with said shifting means retain said shifting means in locked position; electromagnet means for axially shifting said latch sleeve from a remote position relative to said shifting means to said position retaining said shifting means in locked position; and control circuit means operable from exterior of the apparatus for controlling the direction and extent of rotation of said electric motor and the energization and deenergization of said electromagnet means, whereby said downhole tool is moved by said electric motor to said second position by energization of said electromagnet means and returned by said spring to said initial position by de-energization of said electromagnet means.

4. The apparatus of claim 1 further comprising downhole battery means for supplying power to said electric motor; and electromagnetic wave means, including a transmitter exterior of the apparatus, for controlling the energization of said electric motor.

5. The apparatus of claim 3 further comprising downhole battery means for supplying power to said electric motor and said electromagnet means; and electromagnetic wave means, including a transmitter exterior of the apparatus, for selectively controlling the energization of said electric motor and said electromagnet means.

6. The apparatus of claim 5 further comprising an antenna fixedly mounted in a portion of the well conduit, and means for stabilizing said well conduit portion in the well bore to prevent vibration thereof.

7. The apparatus of claim 1 further comprising tubular housing means sealably enclosing said shifting means, said axial force transmitting member, said electric motor and said threaded means; and means for filling said housing means with a lubricating fluid.

8. The apparatus of claim 3 further comprising tubular housing means sealably enclosing said shifting means, said axial force transmitting member, said latch sleeve, said electromagnetic means, said electric motor and said threaded means; and means for filling said housing means with a lubricating fluid.

9. The apparatus of claim 2 further comprising means for equalizing fluid pressure across said valve prior to moving said valve from said closed position.

10. The apparatus of claim 7 further comprising a fluid expansion chamber communicating with the bore of said tubular housing means to accommodate thermal expansion of fluid contained in said tubular housing.

11. The apparatus of claim 8 further comprising a fluid expansion chamber communicating with the bore of said tubular housing means to accommodate thermal expansion of fluid contained in said tubular housing.

12. The apparatus of claim 9 further comprising tubular housing means sealably enclosing said shifting means, said axial force transmitting member, said electric motor and said threaded means; and means for filling said housing means with a lubricating fluid.

13. The apparatus of claim 12 further comprising a fluid expansion chamber communicating with the bore of said tubular housing means to accommodate thermal expansion of fluid contained in said tubular housing.

14. The method of axially shifting a downhole tool in a subterranean well from an initial position to a second position against the bias of a spring comprising the steps of:

axially shifting the downhole tool to the second position by an electric motor driven gearing mechanism;

supplying power to said electric motor from a downhole battery;

latching the downhole tool in said second position by a solenoid shiftable latch energized by said downhole battery, whereby said downhole tool remains in said second position without energization of said electric motor; and selectively controlling the energization of said electric motor and said solenoid by electromagnetic wave signals transmitted through the earth.

15. The method of claim 1 wherein said downhole tool is a valve having an initial closed position and a second open position.

16. Apparatus for shifting a downhole tool axially shiftably mounted in a subterranean well conduit for movement between an initial and a second position comprising, in combination: an axially extending actuator connected at one end to said downhole tool; resilient means opposing axial movement of said actuator in the direction away from said initial position; peripheral abutment means on said actuator; a collet having a ring portion and a plurality of peripherally spaced resilient arm portions disposed adjacent said actuator; said collet arm portions having enlarged head portions engagable with said peripheral abutment means to impart an axial force to said actuator to axially shift said tool in the direction opposed by said resilient means; an axial force transmitting member secured to said collet ring portion; means for mounting said force transmitting member for non-rotatable axial movement relative to said conduit; an electric motor fixedly mounted in said conduit; and threaded means rotatable by said electric motor and threadably engagable with said force transmitting member to axially shift said collet and said actuator in the direction opposed by said resilient means and thereby position the downhole tool in said second position.

17. The apparatus defined in claim 16 wherein said downhole tool comprises a valve having an open and a closed position relative to the bore of the well conduit; said resilient means opposing movement of said valve from said closed position.

18. The apparatus of claim 16 further comprising a latch sleeve axially movable relative to the well conduit; said latch sleeve having locking surfaces movable to a position in engagement with said enlarged head portions of said collet to retain said collet head portions in locked engagement with said peripheral abutment means; electromagnet means for axially shifting said latch sleeve from a remote position relative to said collet head portions to said position retaining said collet head portion in locked engagement with said peripheral abutment means; and control circuit means operable from the well surface for controlling the direction and extent of rotation of said electric motor and the energization and de-energization of said electromagnet means, whereby said downhole tool is moved by said electric motor to said second position by energization of said electromagnet means and returned by said spring to said initial position by de-energization of said electromagnet means.

19. The apparatus of claim 16 further comprising downhole battery means for supplying power to said electric motor; and electromagnetic wave means, including a transmitter at the well surface, for controlling the energization of said electric motor.

20. The apparatus of claim 16 further comprising downhole battery means for supplying power to said electric motor and said electromagnet means; and electromagnetic wave means, including a transmitter exterior of the apparatus, for selectively controlling the energization of said electric motor and said electromagnet means.

21. The apparatus of claim 20 further comprising an antenna fixedly mounted in a portion of the well conduit, and means for stabilizing said well conduit portion in the well bore to prevent vibration thereof.

22. The apparatus of claim 16 further comprising tubular housing means sealably enclosing said collet, said axial force transmitting member, said electric motor and said threaded means; and means for filling said housing means with a lubricating fluid.

23. The apparatus of claim 18 further comprising tubular housing means sealably enclosing said collet, said axial force transmitting member, said latch sleeve, said electromagnetic means, said electric motor and said threaded means; and means for filling said housing means with a lubricating fluid.

24. The apparatus of claim 17 further comprising means for equalizing fluid pressure across said valve prior to moving said valve from said closing position.

25. The apparatus of claim 22 further comprising a fluid expansion chamber communicating with the bore of said tubular housing means to accomodate thermal expansion of fluid contained in said tubular housing.

26. The apparatus of claim 23 further comprising a fluid expansion chamber communicating with the bore of said tubular housing means to accomodate thermal expansion of fluid contained in said tubular housing.

27. The apparatus of claim 24 further comprising tubular housing means sealably enclosing said collet; said axial force transmitting member, said electric motor and said threaded means; and means for filling said housing means with a lubricating fluid.

28. The apparatus of claim 27 further comprising a fluid expansion chamber communicating with the bore of said tubular housing means to accomodate thermal expansion of fluid contained in said tubular housing.

* * * * *